US011092924B2

(12) United States Patent
Ito

(10) Patent No.: US 11,092,924 B2
(45) Date of Patent: Aug. 17, 2021

(54) IMAGE FORMING APPARATUS HAVING A DRIVE UNIT INCLUDING A TORSION SPRING

(71) Applicant: Brother Kogyo Kabushiki Kaisha, Nagoya (JP)

(72) Inventor: Tetsuo Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/696,170

(22) Filed: Nov. 26, 2019

(65) Prior Publication Data

US 2020/0174418 A1 Jun. 4, 2020

(30) Foreign Application Priority Data

Nov. 29, 2018 (JP) ..... JP2018-223464

(51) Int. Cl.
*G03G 21/16* (2006.01)

(52) U.S. Cl.
CPC ..... *G03G 21/1619* (2013.01); *G03G 21/1647* (2013.01)

(58) Field of Classification Search
CPC ..... G03G 21/1619; G03G 21/1647; G03G 15/6511; G03G 15/6502
See application file for complete search history.

(56) References Cited

U.S. PATENT DOCUMENTS

2009/0008868 A1 1/2009 Kuroda
2010/0104311 A1* 4/2010 Okamoto ..... G03G 15/6502 399/75
2013/0223906 A1* 8/2013 Tomatsu ..... G03G 15/6511 399/361
2014/0291923 A1 10/2014 Hashimoto
2014/0294476 A1 10/2014 Hashimoto et al.
2014/0315680 A1 10/2014 Muramatsu et al.
2017/0075279 A1* 3/2017 Hayakawa ..... G03G 15/6511
2017/0275110 A1 9/2017 Hashimoto et al.
2017/0371288 A1 12/2017 Hashimoto

FOREIGN PATENT DOCUMENTS

JP H09-150985 A 6/1997
JP H09-197747 A 7/1997
JP H10-337929 A 12/1998
(Continued)

*Primary Examiner* — Sandra Brase
(74) *Attorney, Agent, or Firm* — Baker Botts L.L.P.

(57) ABSTRACT

An image forming apparatus includes a drive unit disposed inside its housing, a support frame, a protrusion, and a support portion. The drive unit is configured to drive a conveyance unit for conveying a sheet toward an image forming unit. The support frame supports the drive unit. The protrusion has a proximal end and a distal end. The distal end is farther from the support frame than the proximal end is from the support frame. The support portion supports the proximal end of the protrusion. The drive unit further includes a torsion spring including a spiral portion engaged with the protrusion, and a first portion and a second portion each extending from the spiral portion. The first arm is pivotable about a pivot axis and includes a covering portion. The covering portion extends from the first arm and covers the distal end of the protrusion.

8 Claims, 10 Drawing Sheets

(56) References Cited

FOREIGN PATENT DOCUMENTS

| | | | |
|---|---|---|---|
| JP | 2004-021055 | A | 1/2004 |
| JP | 2009-012925 | A | 1/2009 |
| JP | 2013-127604 | A | 6/2013 |
| JP | 2014-199367 | A | 10/2014 |
| JP | 2014-199368 | A | 10/2014 |
| JP | 2017-178486 | A | 10/2017 |
| JP | 20174-227280 | A | 12/2017 |

* cited by examiner 63
632
631
633
634
64
643
647b
646b
646
645
646a
641
651
652
65
653
642
644d
644e
644
647a

IMAGE FORMING APPARATUS HAVING A DRIVE UNIT INCLUDING A TORSION SPRING

CROSS-REFERENCE TO RELATED APPLICATION

This application claims priority from Japanese Patent Application No. 2018-223464 filed on Nov. 29, 2018, the content of which is incorporated herein by reference in its entirety.

TECHNICAL FIELD

Aspects of the disclosure relate to an image forming apparatus.

BACKGROUND

Some known image forming apparatus includes a conveyance unit and a drive unit. The conveyance unit conveys a sheet to an image forming unit. The drive unit drives the conveyance unit. Such an image forming apparatus may include, in the drive unit, a gear mechanism including a plurality of gears and a torsion spring that exerts an urging force on one of the gears. The gear mechanism transmits a drive force to the conveyance unit from a drive source.

In the gear mechanism, the gear includes a cam. The gear is configured to be rotated via the cam acted upon by an urging force of the torsion spring.

The torsion spring is attached to a frame of the image forming apparatus with a spiral portion of the torsion spring being engaged with a protrusion of the frame.

SUMMARY

Nevertheless, during assembly of the torsion spring to the frame, the spiral portion of the torsion spring may be disengaged from the protrusion of the frame.

Accordingly, aspects of the disclosure provide an image forming apparatus having a configuration that may reduce or prevent a torsion spring from being disengaged from a protrusion of the image forming apparatus.

According to one or more aspects of the disclosure, an image forming apparatus includes a drive unit, a support frame, a protrusion, and a support portion. The drive unit is disposed inside a housing of the image forming apparatus and configured to drive a conveyance unit for conveying a sheet toward an image forming unit. The support frame supports the drive unit. The protrusion has a proximal end and a distal end. The distal end is farther from the support frame than the proximal end is from the support frame. The support portion supports the proximal end of the protrusion. The drive unit further includes a torsion spring and a first arm. The torsion spring includes a spiral portion engaged with the protrusion, a first portion extending from the spiral portion, and a second portion extending from the spiral portion. The first arm is pivotable about a pivot axis and includes a covering portion. The covering portion extends from the first arm and covers the distal end of the protrusion.

The above structure reduces or prevents the torsion spring from disengaging from the protrusion.

DETAILED DESCRIPTION

Aspects of the disclosure will be described with reference to the accompanying drawings.

Overall Configuration of Image Forming Apparatus

Figure 1:
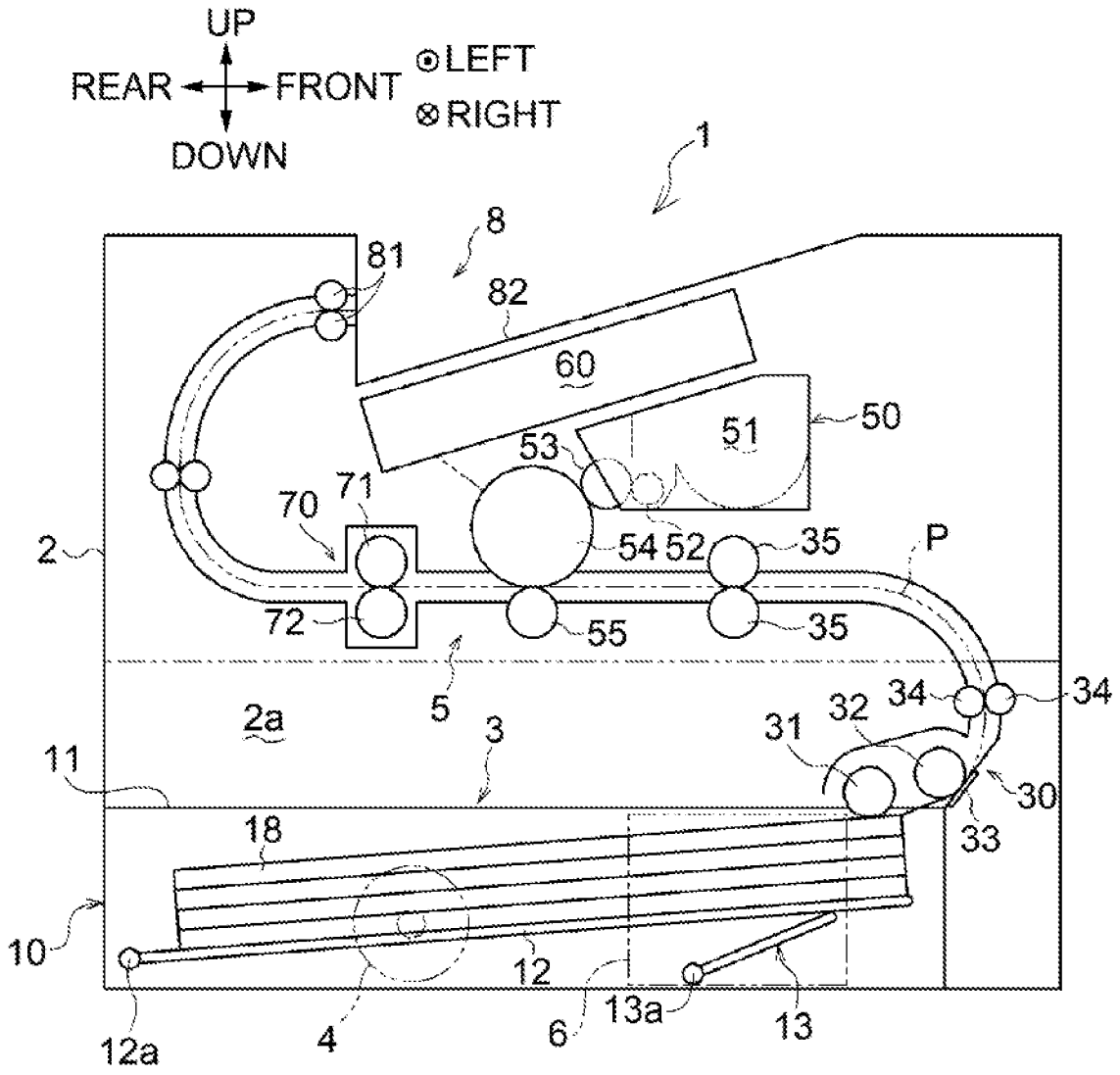
FIG. 1 is a central sectional view of an image forming apparatus according to aspects of the disclosure.

An image forming apparatus 1 illustrated in FIG. 1 is an example of an image forming apparatus.

In the following description, right and left sides of the page of FIG. 1, a side facing out of the page of FIG. 1, and a side facing into the page of FIG. 1 are defined respectively as front, rear, left, and right sides of the image forming apparatus 1. Upper and lower sides of the page of FIG. 1 are defined respectively as upper and lower sides of the image forming apparatus 1.

The image forming apparatus 1 includes a housing 2, a feeder 3, an image forming unit 5, a discharge unit 8, a drive source 4, and a drive unit 6.

The feeder 3 includes a feed tray 10 and a conveyance unit 30. The housing 2 includes a tray accommodating portion 2*a*. The drive unit 6 is configured to drive the conveyance unit 30 by a drive force from the drive source 4.

The housing 2 has a substantially rectangular parallelepiped shape. The housing 2 houses the feeder 3, the image forming unit 5, the drive source 4, and the drive unit 6. The tray accommodating portion 2*a* is positioned at a lower portion of the housing 2. The tray accommodating portion 2*a* houses the feed tray 10 such that the feed tray 10 is slidable in a front-rear direction. The housing 2 has a conveyance path P that may extend from the feeder 3 to the discharge unit 8 via the image forming unit 5.

The feeder 3 is disposed at a lower portion of the image forming apparatus 1. The feeder 3 is configured to feed a sheet 18 to the image forming unit 5 from the feed tray 10 using the conveyance unit 30.

The feed tray 10 includes a tray body 11, a support plate 12, and a lifting plate 13. The tray body 11 has a box shape with its upper end open. The support plate 12 may be a plate-like member. The support plate 12 is disposed in the tray body 11. The support plate 12 is configured to support from below one or more sheets 18 loaded in the tray body 11.

The support plate 12 is movable between a lower position and an upper position higher than the lower position. The lifting plate 13 is disposed below the support plate 12 in the tray body 11. The lifting plate 13 is configured to contact the support plate 12 and move the support plate 12 upward to the upper position from the lower position.

The support plate 12 has a pivot axis 12*a* at its rear end. The support plate 12 is supported by the tray body 11 so as to be pivotable about the pivot axis 12*a*. Pivoting of the support plate 12 on the pivot axis 12*a* enables the position change of the support plate 12 between the lower position and the upper position. The lifting plate 13 has a pivot axis 13*a* at its rear end. The lifting plate 13 is supported by the tray body 11 so as to be pivotable about the pivot axis 13*a*. Pivoting of the lifting plate 13 on the pivot axis 13*a* enables the position change of the support plate 12 between the lower position and the upper position.

The lifting plate 13 is configured to be driven by a drive force transmitted from the drive source 4 via the drive unit 6.

The conveyance unit 30 is configured to separate a single sheet 18 from one or more sheets 18 in the feed tray 10 and convey the separated sheet 18 toward the image forming unit 5. The conveyance unit 30 includes a feed roller 31, a separation roller 32, a separation pad 33, a conveyance roller pair 34, and a registration roller pair 35.

The feed roller 31 is configured to feed one or more sheets 18 toward the separation roller 32 from the feed tray 10. The separation roller 32 is disposed downstream from the feed roller 31 in a sheet conveyance direction. The separation pad 33 is disposed facing the separation roller 32 and is urged toward the separation roller 32.

The separation roller 32 is configured to be driven by a drive force transmitted from the drive source 4 via the drive unit 6.

The separation roller 32 and the separation pad 33 are configured to cooperate to separate a single sheet 18 from the one or more sheets 18 fed by the feed roller 31 toward the separation roller 32. The separation roller 32 is further configured to convey the separated sheet 18 toward the conveyance roller pair 34 along the conveyance path P.

The conveyance roller pair 34 is configured to apply a conveyance force to a sheet 18. The conveyance roller pair 34 is disposed downstream from the separation roller 32 and the separation pad 33 in the sheet conveyance direction. The conveyance roller pair 34 is configured to further convey, toward the registration roller pair 35, along the conveyance path P, a sheet 18 conveyed by the separation roller 32 toward the conveyance roller pair 34.

The registration roller pair 35 is disposed downstream from the conveyance roller pair 34 in the sheet conveyance direction. The registration roller pair 35 is configured to contact a leading edge of a moving sheet 18 to temporarily stop the sheet 18, thereby correcting skewing of the sheet 18. The registration roller pair 35 is further configured to, after temporarily stopping the sheet 18, convey the sheet 18 toward an image transfer position in the image forming unit 5 at a specified timing.

The image forming unit 5 is disposed downstream from the feeder 3 in the sheet conveyance direction. The image forming unit 5 is configured to form an image onto a sheet 18 fed by the feeder 3.

The image forming unit 5 includes a process cartridge 50, an exposure device 60, and a fixing device 70. The process cartridge 50 is configured to transfer an image onto a sheet 18 fed by the feeder 3. The exposure device 60 is configured to expose a circumferential surface of a photosensitive drum 54 of the process cartridge 50. The fixing device 70 is configured to fix an image transferred onto a sheet 18 by the process cartridge 50.

The process cartridge 50 is disposed above the tray accommodating portion 2*a* in the housing 2. The process cartridge 50 includes a developer storage 51, a supply roller 52, a developing roller 53, the photosensitive drum 54, and a transfer roller 55.

The exposure device 60 includes laser diodes, a polygon mirror, a lens, and reflectors. The exposure device 60 is configured to emit a laser beam toward a circumferential surface of the photosensitive drum 54 based on image data inputted into the image forming apparatus 1 to expose the circumferential surface of the photosensitive drum 54.

The developer storage 51 stores toner as a developer. An agitator is configured to agitate toner in the developer storage 51 to supply toner to the supply roller 52 from the developer storage 51. The supply roller 52 is configured to further supply toner to the developing roller 53.

The developing roller 53 is in intimate contact with the supply roller 52. The developing roller 53 is configured to carry toner supplied by the supply roller 52 and positively charged by a slide-contact member. The developing roller 53 is configured to be applied with a positive developing bias by a bias application device.

The photosensitive drum 54 is disposed adjacent to the developing roller 53. The circumferential surface of the photosensitive drum 54 is uniformly and positively charged by a charger and is then exposed by the exposure device 60. A potential of the exposed portion of the photosensitive drum 54 becomes lower than a potential of the other portion and thus an electrostatic latent image is formed on the circumferential surface of the photosensitive drum 54 based on the image data.

Then, the positively charged toner is supplied onto the circumferential surface of the photosensitive drum 54 having the electrostatic latent image by the developing roller 53. The electrostatic latent image is thus visualized to a developer image.

The transfer roller 55 is disposed facing the photosensitive drum 54. The transfer roller 55 is configured to be applied with a negative transfer bias by the bias application device. In a state where the transfer bias is applied to the circumferential surface of the transfer roller 55, the photosensitive drum 54 having the developer image thereon and the transfer roller 55 convey a sheet 18 by pinching the sheet 18 therebetween (e.g., the transfer position). Thus, a developer image is transferred onto the sheet 18 from the circumferential surface of the photosensitive drum 54.

The fixing device 70 includes a heat roller 71 and a pressure roller 72. The heat roller 71 is configured to be rotated by a drive force from the drive source 4 and generate heat by receiving power from a power source. The pressure roller 72 is disposed facing the heat roller 71. The pressure roller 72 is configured to rotate following rotation of the heat roller 71 with intimately contacting the heat roller 71. In response to the fixing device 70 receiving a sheet 18 having a transferred developer image, the heat roller 71 and the pressure roller 72 conveys the sheet 18 by pinching the sheet 18 therebetween to fix the developer image onto the sheet 18.

The discharge unit 8 is disposed downstream from the image forming unit 5 in the sheet conveyance direction. The discharge unit 8 is configured to discharge a sheet 18 having an image formed by the image forming unit 5 to the outside of the housing 2. The discharge unit 8 includes a discharge roller pair 81 and a discharge tray 82. The discharge roller pair 81 is configured to discharge a sheet 18 conveyed from the fixing device 70 to the outside of the housing 2. The discharge tray 82 is defined at the top of the housing 2. The discharge tray 82 is configured to receive and hold one or more sheets 18 discharged to the outside of the housing 2 by the discharge roller pair 81.

Drive Unit

Hereinafter, the drive unit 6 will be described in detail.

The drive unit 6 is configured to receive a drive force from the drive source 4 and output the drive force selectively to the separation roller 32 of the conveyance unit 30 or the lifting plate 13 of the feed tray 10.

Figure 2:
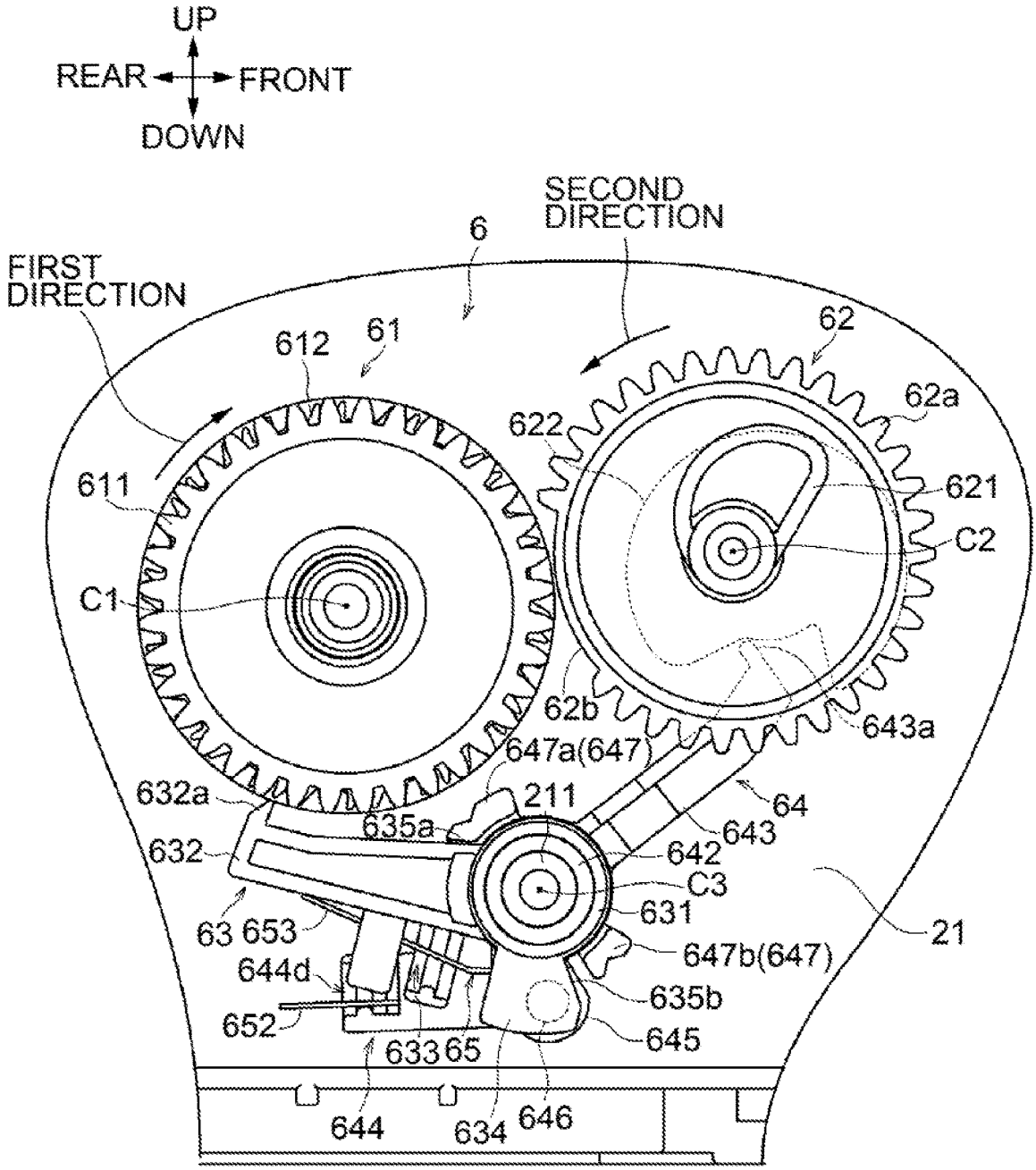
FIG. 2 is a vertical cross sectional view of a drive unit according to aspects of the disclosure.
Figure 3:
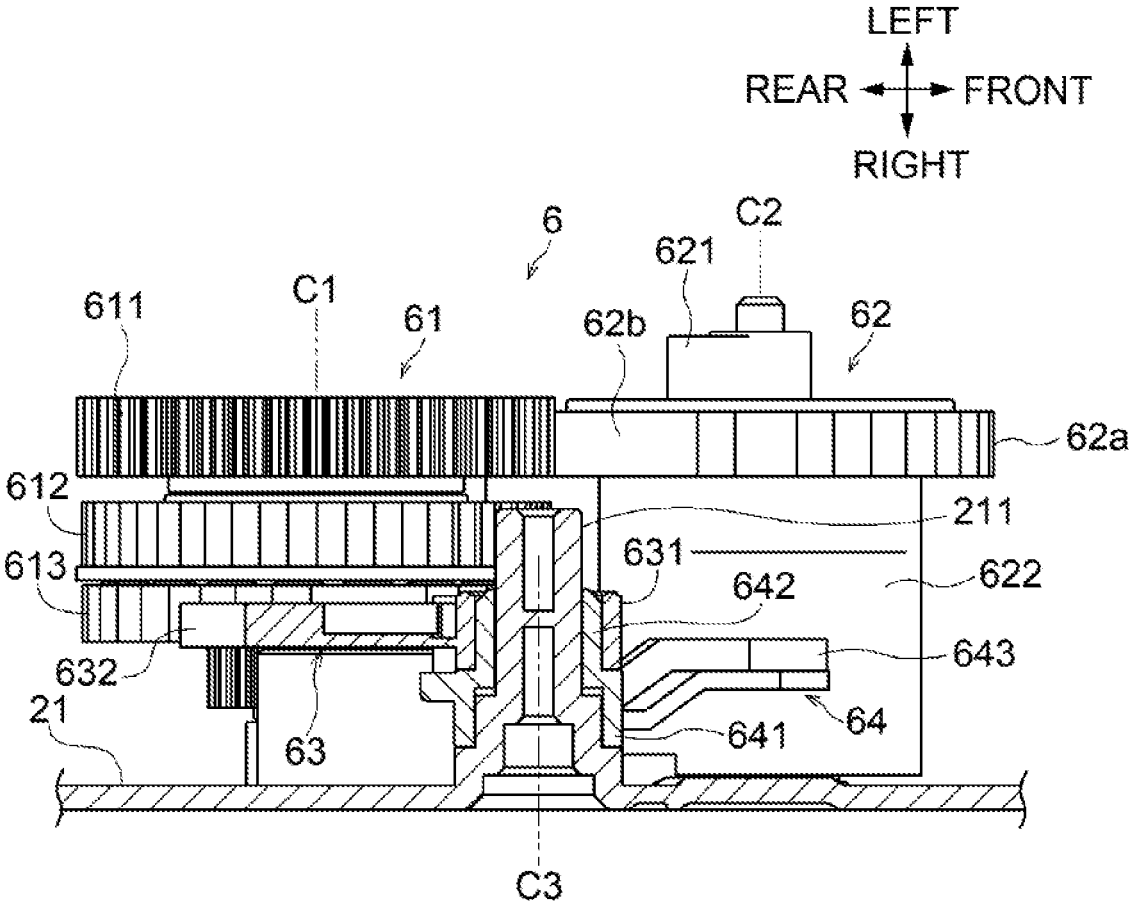
FIG. 3 is a horizontal sectional view of the drive unit according to aspects of the disclosure.

As illustrated in FIGS. 2 and 3, the drive unit 6 includes a switch gear assembly 61, a sector gear 62, a first arm 63, a second arm 64, and a torsion spring 65.

The housing 2 includes a support frame 21. The support frame 21 is disposed inside the housing 2 and at one end portion of the housing 2 in a right-left direction. The support frame 21 extends in the front-rear direction and in an up-down direction. The drive unit 6 is supported by the support unit 21. In this example, the support frame 21 may be disposed inside the housing 2 and at a left end portion of the housing 2.

The switch gear assembly 61 is supported by the support frame 21. The switch gear assembly 61 includes an input gear 611, a first output gear 612, and a second output gear 613. The input gear 611 is an example of a force receiving portion configured to receive a drive force. The first output gear 612 is an example of a first force output portion configured to output the drive force. The second output gear 613 is an example of a second force output portion configured to output the drive force.

The input gear 611, the first output gear 612, and the second output gear 613 are disposed next to each other in the right-left direction. The input gear 611, the first output gear 612, and the second output gear 613 are each configured to rotate about a first axis C1 extending in the right-left direction.

The input gear 611 is configured to receive a drive force from the drive source 4 to rotate in a first direction. In this example, the first direction may be a clockwise direction in FIG. 2.

The switch gear assembly 61 includes a planetary gear system. More specifically, for example, the switch gear assembly 61 is configured such that, in a case where the second output gear 613 is not allowed to rotate while the input gear 611 receives a drive force, the first output gear 612 is allowed to rotate. The switch gear assembly 61 is further configured such that, in a case where the second output gear 613 is allowed to rotate while the input gear 611 receives a drive force, the first output gear 612 is not allowed to rotate. That is, the switch gear assembly 61 is configured to change its force output state between a state in which the first output gear 612 outputs a drive force and another state in which the second output gear 613 outputs a drive force in response to the rotation state of the second output gear 613.

In the drive unit 6, for example, the first output gear 612 is connected to the lifting plate 13 and the second output gear 613 is connected to the separation roller 32. In response to the first output gear 612 rotating, the drive unit 6 outputs a drive force to the lifting plate 13. In response to the second output gear 613 rotating, the drive unit 6 outputs a drive force to the separation roller 32.

The sector gear 62 is supported by the support frame 21. The sector gear 62 is configured to rotate about a second axis C2 extending in a direction parallel to the first axis C1. The sector gear 62 has teeth on a portion of its circumference. That is, the sector gear 62 has a toothed portion 62*a* and a toothless portion 62*b*.

The sector gear 62 has one side (e.g., a side facing out of the page in FIG. 2) having a first cam 621 and the other side (e.g., a side facing into the page in FIG. 2) having a second cam 622.

The toothed portion 62*a* of the sector gear 62 is meshable with teeth of the input gear 611. In a state where the toothed portion 62*a* faces and meshes with teeth of the input gear 611, the sector gear 62 receives a drive force from the input gear 611 to rotate in a second direction. In this example, the second direction may be a counterclockwise direction in FIG. 2.

In a state where the toothless portion 62*b* of the sector gear 62 faces the input gear 611 (i.e., in a state where the toothed portion 62*a* of the sector gear 62 does not mesh with any teeth of the input gear 611), the sector gear 62 might not receive a drive force from the input gear 611 and is thus not allowed to rotate.

The first cam 621 is urged in its rotating direction by an urging member. Urging the first cam 621 by the urging member may enable the sector gear 62 whose toothless portion 62*b* faces the input gear 611 to rotate in the second direction.

The sector gear 62 is configured to change its state between a rotation restricted state and a rotation allowed state. In the rotation restricted state, the toothless gear 62 is at standstill with the toothless portion 62*b* facing the input gear 611. In response to the state change of the sector gear 62 to the rotation allowed state from the rotation restricted state, the sector gear 62 starts rotating in the second direction by an urging force of the urging member.

The support frame 21 includes a support shaft 211 protruding toward the left. The support shaft 211 has a third axis C3. The third axis C3 extends in a direction parallel to the first axis C1. The third axis C3 is an example of a pivot axis of each of the first arm 63 and the second arm 64.

Figure 4A:
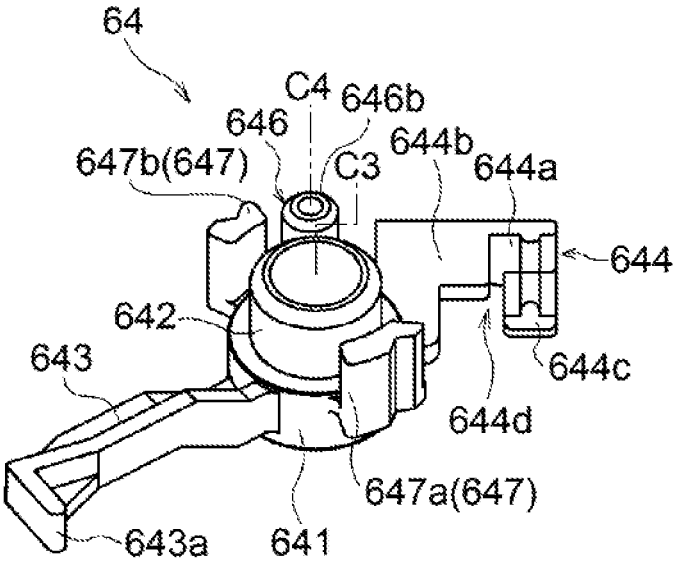
FIGS. 4A and 4B are perspective views each illustrating a second arm according to aspects of the disclosure.
Figure 4B:
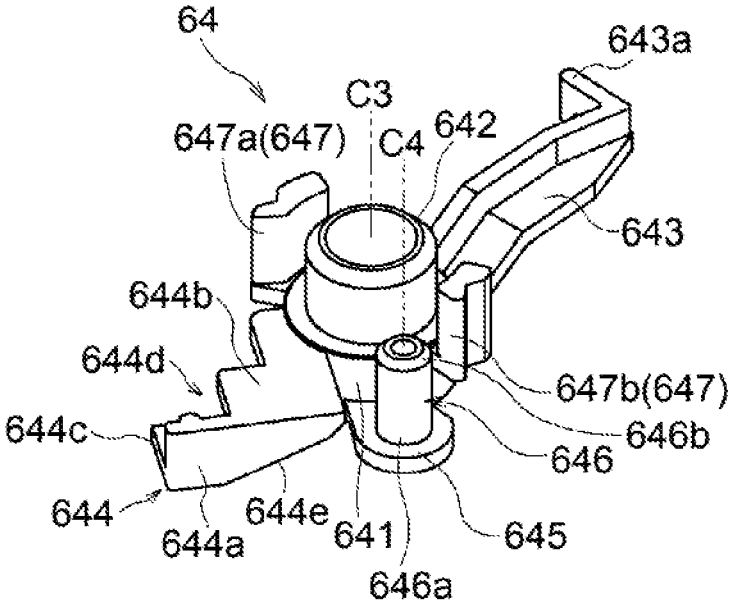

As illustrated in FIGS. 4A and 4B, the second arm 64 includes an engagement portion 641, an engagement portion 642, a second arm portion 643, a guide arm portion 644, a support portion 645, a protrusion 646, and a handle 647.

As illustrated in FIG. 3, the engagement portion 641 has a hollow cylindrical shape. The engagement portion 641 is rotatably engaged with the support shaft 211. The engagement portion 642 has a hollow cylindrical shape. The engagement portion 642 is rotatably engaged with the support shaft 211. The engagement portion 642 is positioned farther from the support frame 21 than the engagement portion 641 is from the support frame 21 in the right-left direction. The engagement portion 642 is one piece with the engagement portion 641.

The engagement portion 642 has a diameter that is smaller than a diameter of the engagement portion 641. The second arm 64 has a stepped portion at a border between the engagement portion 641 and the engagement portion 642. The second arm 64 is supported by the support shaft 211 through the engagement of the engagement portions 641 and 642 with the support shaft 211 such that the second arm 64 is pivotable about the third axis C3.

The second arm portion 643 extends from the engagement portion 641 in a direction perpendicular to a direction in which the third axis C3 extends (hereinafter, referred to as the third axis C3 direction). The second arm portion 643 includes a second pawl 643*a* protruding from a distal end of the second arm portion 643 in a pivot direction of the second arm portion 643.

As illustrated in FIG. 2, in a state where the second arm 64 is supported by the support shaft 211, the second arm portion 643 extends diagonally upward toward the front and the second pawl 643*a* points substantially upward.

The guide arm portion 644 extends from the engagement portion 641 in another direction perpendicular to the third axis C3 direction. More specifically, for example, the guide arm portion 644 extends from the engagement portion 641 in a direction substantially opposite to the direction in which the second arm portion 643 extends.

The guide arm portion 644 has a first wall 644*a*, a second wall 644*b*, and a third wall 644*c*. The first wall 644*a* faces the pivot direction of the second arm 64. The second wall 644*b* extends from one of ends of the first wall 644*a* in the third axis C3 direction, and faces the third axis C3 direction. The third wall 644*c* extends from the other end of the first wall 644*a* in the third axis C3 direction, and faces the third axis C3 direction. The one end from which the second wall 644*b* extends is farther from the support frame 21 than the other end of the first wall 644*a* is from the support frame 21 in the third axis C3 direction.

A portion defined by the first wall 644*a*, the second wall 644*b*, and the third wall 644*c* of the guide arm portion 644 functions as a restriction portion 644*d* that restricts movement of a first portion 652 of the torsion spring 65. The first wall 644*a* has an inclined side. The inclined side extends in a direction away from support frame 21 as the inclined side extends toward the engagement portion 641. The inclined side includes a guide portion 644*e* configured to guide the first portion 652 of the torsion spring 65 during attachment of the torsion spring 65 to the second arm 64.

The support portion 645 may be a plate-like member. The support portion 645 extends from the engagement portion 641 in another direction perpendicular to the third axis C3 direction. More specifically, for example, the support portion 645 extends from the engagement portion 641 in a direction different from the direction in which the second arm portion 643 extends and the direction in which the guide arm portion 644 extends. The support portion 645 is located at one end of the engagement portion 641 in the third axis C3 direction. The one end of the engagement portion 641 is closer to the support frame 21 than the other end of the engagement portion 641 is to the support frame 21 in the third axis C3 direction.

The protrusion 646 may be a shaft member. The protrusion 646 protrudes from the support portion 645 in a direction away from the support frame 21 with respect to the third axis C3 direction. The protrusion 646 includes a proximal end 646*a* and a distal end 646*b*. The proximal end 646*a* is closer to the support portion 645 than the distal end 646*b* is to the support portion 645. The distal end 646*b* is positioned opposite to the proximal end 646*a*. The protrusion 646 has a fourth axis C4. The fourth axis C4 extends parallel to the third axis C3.

That is, the support portion 645 supports the proximal end 646*a* of the protrusion 646, and the protrusion 646 is located at the second arm 64.

The support portion 645 is supported by the engagement portion 641 and the engagement portion 641 is supported by the support shaft 211 of the support frame 21. Thus, the protrusion 646 is indirectly supported by the support frame 21.

In another example, the protrusion 646 may be directly supported by the support frame 21. In such a case, for example, the proximal end 646*a* of the protrusion 646 may be directly supported by the support frame 21, and the protrusion 646 may protrude from the support frame 21 such that the distal end 646*b* is positioned farther from the support frame 21 than the proximal end 646*a* is from the support frame 21. In this case, the support frame 21 may serve as the support portion of the protrusion 646.

The handle 647 includes a first contactable portion 647*a* and a second contactable portion 647*b*. The first contactable portion 647*a* and the second contactable portion 647*b* each extend from the engagement portion 641 in a direction away from the support frame 21 with respect to the third axis C3 direction.

The first contactable portion 647*a* and the second contactable portion 647*b* are located around the engagement portion 642 and spaced from the engagement portion 642. A distal end (which may be farther from the support frame 21 than a proximal end is from the support frame 21) of the first contactable portion 647*a* is located at substantially the same level as a distal end (which may be farther from the support frame 21 than a proximal end is from the support frame 21) of the second contactable portion 647*b*.

The first contactable portion 647*a* and the second contactable portion 647*b* are positioned at respective phases different from the second arm portion 643, the guide arm 644, and the support portion 645 around the third axis C3. The first contactable portion 647*a* and the second contactable portion 647*b* are located opposite to each other with respect to the engagement portion 642.

Figure 5:
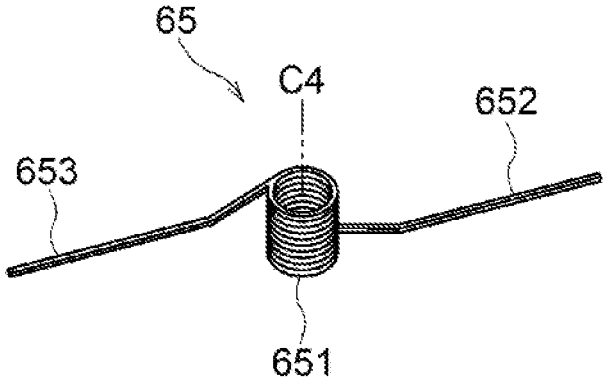
FIG. 5 is a perspective view of a torsion spring according to aspects of the disclosure.

As illustrated in FIG. 5, the torsion spring 65 includes a spiral portion 651, the first portion 652, and a second portion 653. The spiral portion 651 is engageable with the protrusion 646 of the second arm 64 and may be engaged with the protrusion 646. The first portion 652 and the second portion 653 each extend from the spiral portion 651. The spiral portion 651 has a cylindrical shape having a hollow core and the fourth axis C4. The first portion 652 and the second portion 653 of the torsion spring 65 each extend in respective directions perpendicular to the fourth axis C4. The first portion 652 and the second portion 653 extend in the respective directions opposite to each other when the torsion spring 65 is in its natural state.

The torsion spring 65 may be supported by the protrusion 646 through engagement of the spiral portion 651 with the protrusion 646 such that the torsion spring 65 is rotatable about the fourth axis C4.

Figure 6A:
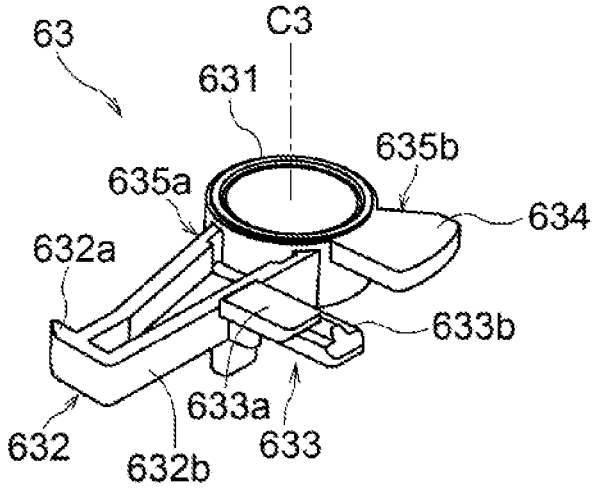
FIGS. 6A and 6B are perspective views each illustrating a first arm according to aspects of the disclosure.
Figure 6B:
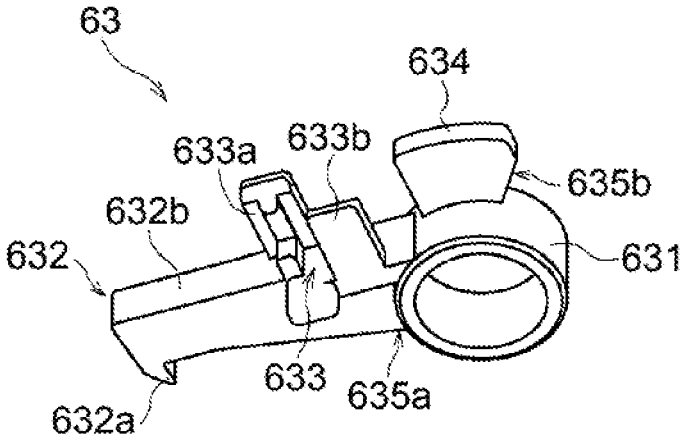

As illustrated in FIGS. 6A and 6B, the first arm 63 includes an engagement portion 631, a first arm portion 632, a guide portion 633, a covering portion 634, a first position restriction portion 635*a* and a second position restriction portion 635*b*.

As illustrated in FIG. 3, the engagement portion 631 has a hollow cylindrical shape. The engagement portion 631 is rotatably engaged with the engagement portion 642 of the second arm 64. The first arm 63 is supported by the second arm 64 through the engagement of the engagement portion 631 with the engagement portion 642 of the second arm 64 such that the first arm 63 is pivotable about the third axis C3. The first arm 63 and the second arm 64 are pivotable about a common axis (e.g., the third axis C3).

The first contactable portion 647*a* and the second contactable portion 647*b* of the handle 647 are located around the engagement portion 631 of the first arm 63 engaged with the engagement portion 642 of the second engagement portion 642. That is, the first contactable portion 647*a* and the second contactable portion 647*b* of the handle 647 each extend to a respective position in the third axis C3 direction such that the first contactable portion 647*a* and the second contactable portion 647*b* each overlap the engagement portion 631 of the first arm 63 when viewed in the direction perpendicular to the third axis C3 direction. The third axis C3 direction may be a protruding direction in which the protrusion 646 protrudes.

In a state where the first arm 63 is supported by the second arm 64, the second arm 64 is disposed closer to the proximal end 646*a* of the protrusion 646 than the first arm 63 is to the proximal end 646*a* in the third axis C3 direction. More specifically, in that state, the second arm portion 643 of the second arm 64 is located closer to the proximal end 646*a* of the protrusion 646 than the first arm portion 632 of the first arm 63 is to the proximal end 646*a* in the third axis C3 direction.

The first arm portion 632 extends from the engagement portion 631 in a direction perpendicular to the third axis C3 direction. The first arm portion 632 includes a first pawl 632*a* protruding from a distal end of the first arm portion 632 in a pivot direction of the first arm portion 632. As illustrated in FIG. 2, in a state where the first arm portion 632 is supported by the second arm 64, the first arm portion 632 diagonally extends upward toward the rear and the first pawl 632*a* points substantially upward. The first pawl 632*a* is meshable with the second output gear 613.

The first arm portion 632 further has a first guide surface 632*b* at an end face on an opposite side to the side toward which the first pawl 632*a* of the first arm portion 632 protrudes. The first guide surface 632*b* faces the pivot direction of the first arm portion 632. The first arm portion 632 further includes a second portion 633*a* having a second guide surface and a third portion 633*b* having a third guide surface. The second portion 633*a* and the third portion 633*b* each extend from the first guide surface 632*b* in a direction opposite to the protruding direction of the first pawl 632*a*.

The second portion 633*a* and the third portion 633*b* are spaced from each other by a specified gap in the third axis C3 direction. In addition, the second portion 633*a* and the third portion 633*b* are located at respective different positions in a direction in which the first arm portion 632 extends. A portion defined by the first surface 632*b*, the second guide surface of the second portion 633*a*, and the third guide surface of the third portion 633*b* functions as the guide portion 633 configured to guide movement of the second portion 653 of the torsion spring 65.

The covering portion 634 may have a plate-like shape. The covering portion 634 extends outward from the engagement portion 631 in a radial direction of the engagement portion 631. More specifically, for example, the covering portion 634 may have a substantially fan shape. A width of the covering portion 634 may increase as the covering portion 634 extends outward in the radial direction of the engagement portion 631. The covering portion 634 is located at one end of the engagement portion 631 in the third axis C3 direction. The one end of the engagement portion 631 is farther from the support frame 21 than the other end of the engagement portion 631 in the third axis C3 direction is from the support frame 21.

The covering portion 634 is positioned farther from the support frame 21 than the distal end 646*b* of the protrusion 646 is from the support frame 21 in the third axis C3 direction. In other words, the covering portion 634 is spaced from the distal end 646*b* of the protrusion 646 by a particular dimension smaller than a dimension of the spiral portion 651 of the torsion spring 65 in the third axis C3. The covering portion 634 covers the distal end 646*b* of the protrusion 646. The covering portion 634 is an example of a covering portion covering the distal end 646*b* of the protrusion 646.

The first arm portion 632 includes the first position restriction portion 635*a* at a surface thereof facing the pivot direction of the first arm 63 and facing the first contactable portion 647*a* of the second arm 64. The first position restriction portion 635*a* is contactable with the first contactable portion 647*a*. The covering portion 634 includes the second position restriction portion 635*b* at a surface thereof facing the pivot direction of the first arm 63 and facing the second contactable portion 647*b* of the second arm 64. The second position restriction portion 635*b* is contactable with the second contactable portion 647*b*.

Figure 7A:
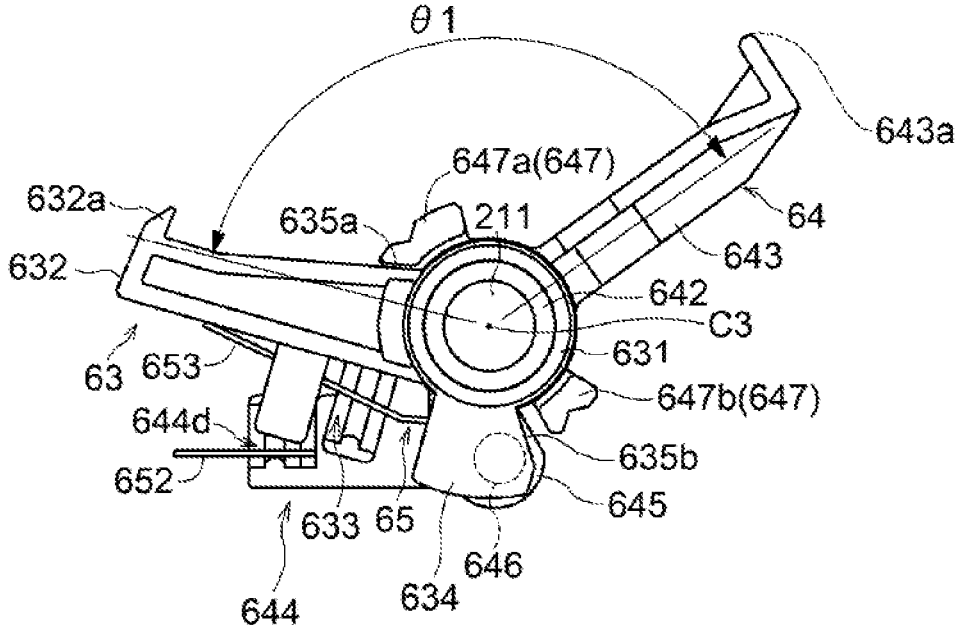
FIG. 7A is a perspective view of the first arm, the second arm, and the torsion spring that are assembled according to aspects of the disclosure, wherein the first arm is located at a first position.
Figure 7B:
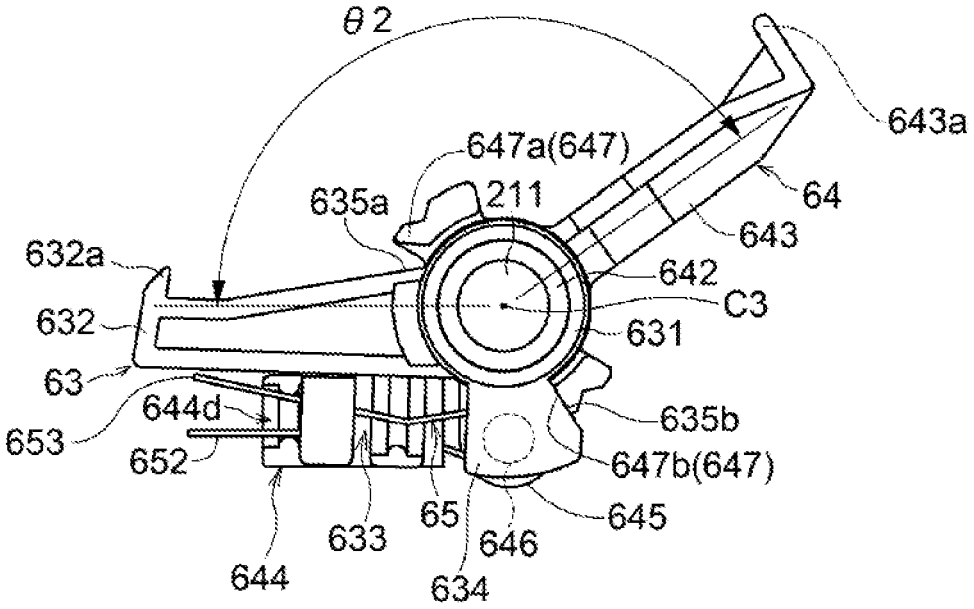
FIG. 7B is a perspective view of the first arm, the second arm, and the torsion spring that are assembled according to aspects of the disclosure, wherein the first arm is located at a second position.

As illustrated in FIGS. 7A and 7B, the first arm 63, the second arm 64, the torsion spring 65 are assembled such that the engagement portion 631 of the first arm 63 is engaged with the engagement portion 642 of the second arm 64 and the torsion spring 65 is positioned between the first arm 63 and the second arm 64.

In such an assembled state, the first portion 652 of the torsion spring 65 is engaged with the restriction portion 644*d* of the second arm 64 and the second portion 653 of the torsion spring 65 is engaged with the guide portion 633 of the first arm 63. The first arm 63 and the second arm 64 are thus urged by the torsion spring 65 such that the first arm 63 pivots in an approaching direction in which the first pawl 632*a* moves toward the second pawl 643*a* and the second arm 64 pivots in an approaching direction in which the second pawl 643*a* moves toward the first pawl 643*a*.

In response to the first arm 63 and the second arm 64 pivoting in their respective approaching directions by an urging force of the torsion spring 65, the first position restriction portion 635*a* of the first arm 63 and the first contactable portion 647*a* of the second arm 64 contact with each other, thereby restricting the first arm 63 and the second arm 64 from further rotating in their respective approaching directions.

The position of the first arm 63 relative to the second arm 64 in a state where the first position restriction portion 635*a* and the first contactable portion 647*a* contact with each other may refer to a first position (refer to FIG. 7A). That is, the first arm 63 is configured to be held in the first position by the first position restriction portion 635*a*. When the first arm 63 is located at the first position, the first contactable portion 647*a* contacts the first position restriction portion 635*a*. In a state where the first position restriction portion 635*a* contacts the first contactable portion 647*a*, the first arm 63 and the second arm 64 form an angle θ1 therebetween.

In response to the first arm 63 and the second arm 64 pivoting in their respective separating directions against the urging force of the torsion spring 65, the second position restriction portion 635*b* of the first arm 63 and the second contactable portion 647*a* of the second arm 64 contact with each other, thereby restricting the first arm 63 and the second arm 64 from further rotating in their respective separating directions. When the first arm 63 pivots in the separating direction, the first pawl 632*a* moves in a direction away from the second pawl 643*a*. When the second arm 64 pivots in the separating direction, the second pawl 643*a* moves in a direction away from the first pawl 632*a*.

The position of the first arm 63 relative to the second arm 64 in a state where the second position restriction portion 635*b* and the second contactable portion 647*b* contact with each other may refer to a second position (refer to FIG. 7B). That is, the first arm 63 is configured to be held in the second position by the second position restriction portion 635*b*.

When the first arm 63 is located at the second position, the second contactable portion 647*b* contacts the second position restriction portion 635*b*.

In a state where the second position restriction portion 635*b* contacts the second contactable portion 647*b*, the first arm 63 and the second arm 64 form an angle θ2 therebetween. The angle θ2 is larger than the angle θ1.

As described above, the first arm 63 is rotatable between the first position and the second position. When the first arm 63 is located at the first position, the covering portion 634 covers the distal end 646*b* of the protrusion 646. When the first arm 63 is located at the second position, the covering portion 634 also covers the distal end 646*b* of the protrusion 646. Further, when the first arm 63 is located at any position between the first position and the second position, the covering portion 634 covers the distal end 646*b* of the protrusion 646.

As described above, the covering portion 634 covers the distal end 646*b* of the protrusion 646 at all times. Consequently, once the first arm 63, the second arm 64, the torsion spring 65 are assembled, the covering portion 634 may reduce or prevent the torsion spring 65 engaged with the protrusion 646 from disengaging therefrom via the distal end 646*b*.

That is, the covering portion 634 covers the distal end 646*b* of the protrusion 646 to reduce or prevent the torsion spring 65 from disengaging from the protrusion 646.

The first position restriction portion 635*a* causes the first arm 63 to stop at the first position such that, when the first arm 63 is located at the first position, the covering portion 634 covers the distal end 646*b* of the protrusion 646. The first position restriction portion 635*a* further causes the first arm 63 to stop at the second position such that, when the first arm 63 is located at the second position, the covering portion 634 covers the distal end 646*b* of the protrusion 646.

Such a configuration may enable the covering portion 634 to cover the distal end 646*b* of the protrusion 646 at all times when the first arm 63 pivots between the first position and the second position. The effect of the covering portion 634 that reduces or prevents disengagement of the torsion spring 65 may be thus achieved not only when the torsion spring 65 is assembled to the first arm 63 and the second arm 64 but also when the drive unit 6 is driven.

The protrusion 646 that may be engaged with the torsion spring 65 is located at the second arm 64 that may be disposed adjacent to the first arm 63. Such a configuration may thus enable the torsion spring 65 and the covering portion 634 to be disposed adjacent to each other. Consequently, as compared with a case where the first arm 63 and the second arm 64 are disposed far from each other, the covering portion 634 may have a smaller size, thereby enabling a size reduction of the drive unit 6.

Procedure for Assembling First Arm, Second Arm, and Torsion Spring

Hereinafter, a procedure for assembling the first arm 63, the second arm 64, and the torsion spring 65 will be described.

Figures 8A, 8B, 8C, 8D:
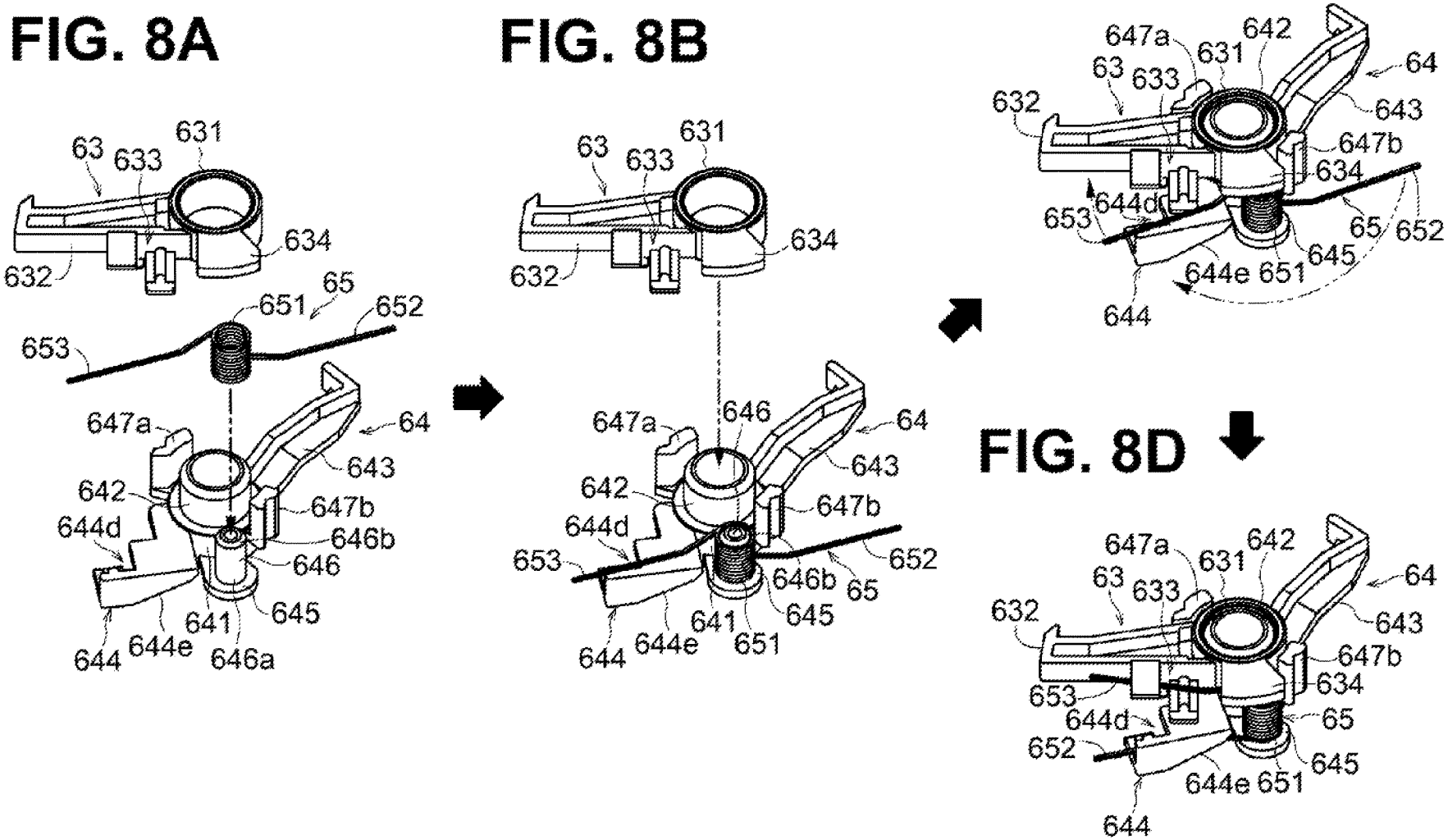
FIGS. 8A to 8D illustrate a procedure for assembling the first arm, the second arm, and the torsion spring according to aspects of the disclosure.

As illustrated in FIG. 8A, the second arm 64 is oriented such that the distal end 646*b* of the protrusion 646 is located above the proximal end 646*a* of the protrusion 646. Then, the spiral portion 651 of the torsion spring 65 is placed around the protrusion 646 from the distal end 646*b*. More specifically, for example, the torsion spring 65 is placed around the protrusion 646 such that the first portion 652 of the torsion spring 65 is located on the second arm portion 643 side relative to the protrusion 646 and the second portion 653 of the torsion spring 65 is located on the guide arm portion 644 side relative to the protrusion 646.

Thereafter, as illustrated in FIG. 8B, the engagement portion 631 of the first arm 63 is engaged with the engagement portion 642 of the second arm 64. More specifically, for example, the first arm 63 is engaged with the second arm 64 such that the first arm portion 632 is located on the guide arm portion 644 side relative to the engagement portion 642.

Then, as illustrated in FIG. 8C, the first portion 652 of the torsion spring 65 is turned toward the guide arm portion 644 (e.g., clockwise in FIG. 8C). In response to the turn of the first portion 652 of the torsion spring 65, the second portion 653 of the torsion spring 65 moves correspondingly and is thus engaged with the guide portion 633 of the first arm portion 632. After the second portion 653 of the torsion spring 65 is engaged with the guide portion 633, a further clockwise movement of the second portion 653 is restricted and a future movement of the second portion 653 is guided by the guide portion 633. In response to a further clockwise turn of the first portion 652 of the torsion spring 65 after the second portion 653 of the torsion spring 65 is engaged with the guide portion 633, the torsion spring 65 generates an urging force acting in a direction opposite to the turning direction of the torsion spring 65.

Thereafter, as illustrated in FIG. 8D, the first portion 652 of the torsion spring 65 is further turned clockwise to be engaged with the restriction portion 644*d* of the guide arm portion 644 of the second arm 64. In such a state, although the first portion 652 of the torsion spring 65 is urged in the direction opposite to the turning direction of the torsion spring 65 by the urging force of the torsion spring 65, the engagement of the first portion 652 with the restriction portion 644*d* restricts the movement of the first portion 652 of the torsion spring 65 in the urging direction relative to the second arm 64.

In a state where the first portion 652 of the torsion spring 65 is engaged with the restriction portion 644*d* of the second arm 64 and the second portion 653 of the torsion spring 65 is engaged with the guide portion 633 of the first arm 63, the first arm 63 and the second arm 64 are urged by the torsion spring 65 such that the first arm 63 pivots in its approaching direction in which the first pawl 632*a* moves toward the second pawl 643*a* and the second arm 64 pivots in its approaching direction in which the second pawl 643*a* moves toward the first pawl 632*a*.

In the step of engaging the first portion 652 of the torsion spring 65 with the restriction portion 644*d*, the guide portion 644*e* may facilitate the engaging step. More specifically, for example, the first portion 652 is turned toward the restriction portion 644*d* with contacting the guide portion 664*e* of the second arm 64. By doing so, the first portion 652 is guided downward along the inclined guide portion 644*e* and may be thus engaged with the restriction portion 644*d* readily.

After the first arm 63, the second arm 64, and the torsion spring 65 are assembled into a unit, the unit is assembled to the support frame 21. More specifically, for example, the engagement portion 641 of the second arm 64 is engaged with the support shaft 211 of the support frame 21 to assemble the unit into the support frame 21.

In the step of assembling the unit to the support frame 21, a working robot may hold the handle 647 of the second arm 64 from above to pick up the unit.

In the unit, the second arm 64 is positioned below the first arm 63 and the torsion spring 65. Thus, if the second arm 64 does not include the handle 647, it may be difficult for the working robot to pick up the second arm 64.

In this example, the second arm 64 includes the handle 647 extending from the second arm 64 to the particular position in the protruding direction of the protrusion 646 such that the handle 647 overlaps the first arm 63 when viewed in the direction perpendicular to the third axis C3 direction. Such a configuration may thus enable the working robot to hold the handle 647 of the second arm 64 and pick up the unit readily without dropping. In particular, the handle 647 includes the first contactable portion 647*a* and the second contactable portion 647*b* located opposite to each other relative to the engagement portion 642. Such a configuration may thus enable the working robot to pick up the unit further readily. In addition, the handle 647 may enable a human operator to also hold and lift the unit readily.

The first contactable portion 647*a* of the handle 647 causes the first arm 63 to stop at the first position by contacting the first position restriction portion 635*a* when the first arm 63 is located at the first position. The second contactable portion 647*b* of the handle 647 causes the first arm 63 to stop at the second position by contacting the second position restriction portion 635*b* when the first arm 63 is located at the second position.

As described above, each of the first contactable portion 647*a* and the second contactable portion 647*b* of the handle 647 may be used for holding the second arm 64 and for causing the first arm 63 to stop at the first position or at the second position.

Operation of Drive Unit

Hereinafter, operation of the drive unit 6 will be described in detail.

As illustrated in FIG. 2, in a state where the toothless portion 62*b* of the sector gear 62 faces the input gear 611 and the sector gear 62 is not allowed to rotate, the sector gear 62 might not rotate even if the input gear 611 is driven to be rotated. The second arm 64 is urged by the urging member in a direction in which the second arm 64 pivots about the third axis C3 such that the second pawl 643*a* moves toward the second cam 622 of the sector gear 62. In such a state, the first arm 63 is located at the first position.

The second cam 622 is configured to, in response to the sector gear 62 rotating, pivot the second arm 64 about the third axis C3. The first arm 63 is configured to, in response to the second arm 64 being pivoted by the second cam 622, move between an engaged position and a disengaged position. When the first arm 63 is located at the engaged position, the first pawl 632*a* is in engagement with a tooth of the second output gear 613. When the first arm 63 is located at the disengaged position, the first pawl 632*a* is not in engagement with any tooth of the second output gear 613.

In a state where the toothless portion 62*b* and the input gear 611 face each other, the second arm 64 is oriented such that the second pawl 643*a* is located relatively close to the second axis C2 and the first arm 63 is located at the disengaged position where the first pawl 632*a* is not in engagement with any tooth of the second output gear 613.

In the state illustrated in FIG. 2, the second output gear 613 is not in engagement with the first pawl 632*a* of the first arm 63 and is thus allowed to rotate. Consequently, in response to the input gear 611 starting rotating in such a state, the second output gear 613 rotates to output a drive force and the first output gear 612 is not allowed to rotate.

In response to changing of the state of the sector gear 62 to allow the sector gear 62 to rotate from the state illustrated in FIG. 2, the sector gear 62 starts rotating in the second direction by the urging member to cause the toothed portion 62*a* of the sector gear 62 to mesh with teeth of the input gear 611.

Figure 9:
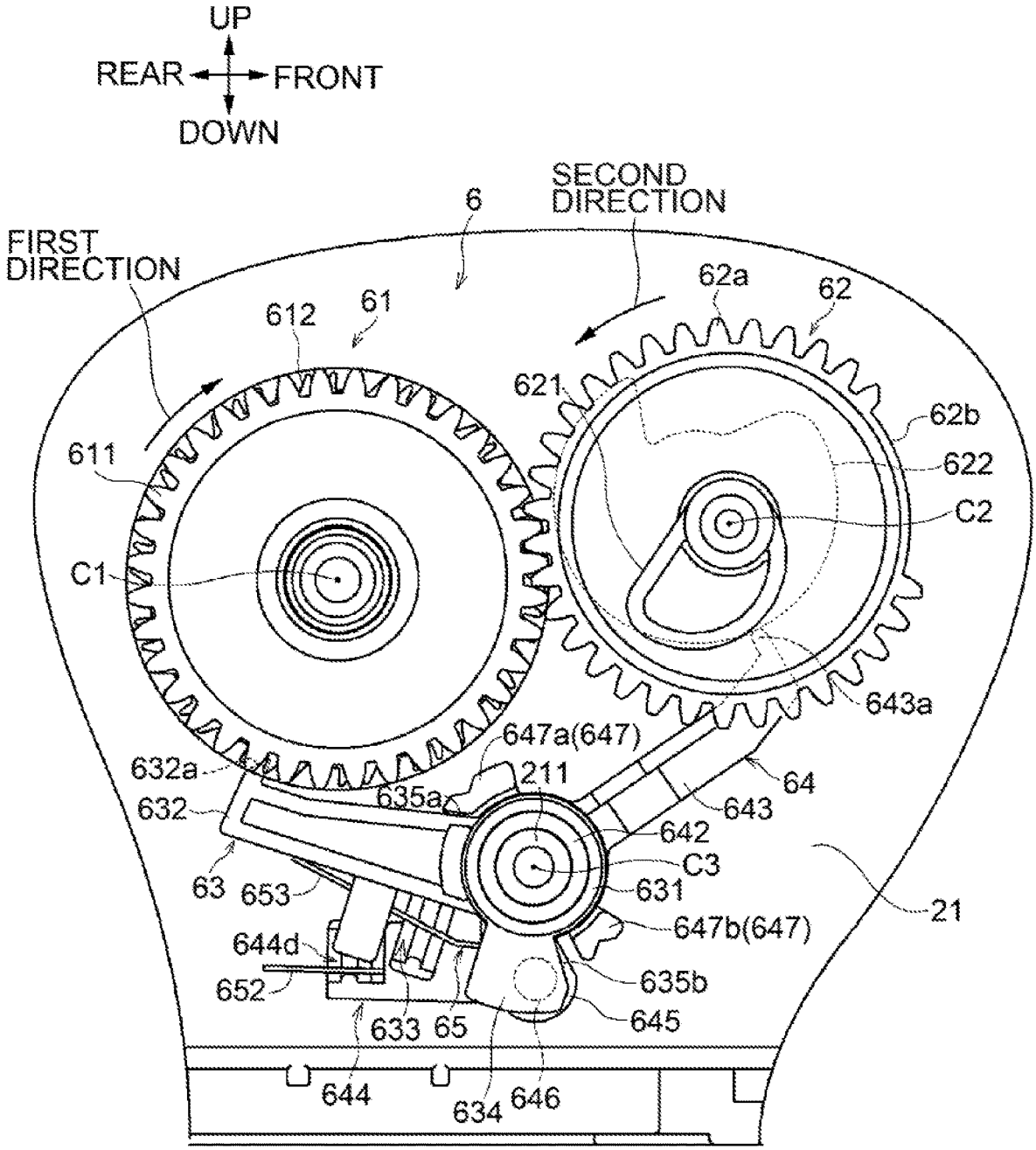
FIG. 9 is a vertical cross sectional view of the drive unit according to aspects of the disclosure, wherein a first pawl of the first arm is in engagement with a second output gear and the first arm is located at the first position.

Thereafter, the sector gear 62 is rotated by a drive force transmitted from the input gear 611. As illustrated in FIG. 9, in response to the input gear 611 rotating the sector gear 62, the second arm 64 pivots in a direction in which the second pawl 643*a* moves away from the second axis C2. The first arm 63 pivots to the engaged position in accordance with the rotation of the second arm 64 and thus the first pawl 632*a* of the first arm 63 comes into engagement with a tooth of the second output gear 613.

In the state illustrated in FIG. 9, the second output gear 613 is in engagement with the first pawl 632*a*. Thus, the second output gear 613 is not to be allowed to rotate while the first output gear 612 is allowed to rotate, thereby enabling the first output gear 612 to output a drive force. In such a state, the first arm 63 is located at the first position and the first contactable portion 647*a* and the first position restriction portion 635*a* are in contact with each other.

In response to the input gear 611 further rotating from the state illustrated in FIG. 9, the second cam 622 causes the second arm 64 to further pivot in the direction in which the second pawl 643*a* moves away from the second axis C2. In such a state, the first arm 63 is not allowed to rotate by the engagement of the first pawl 632*a* and the second output gear 613. The second arm 64 thus pivots relative to the first arm 63.

Figure 10:
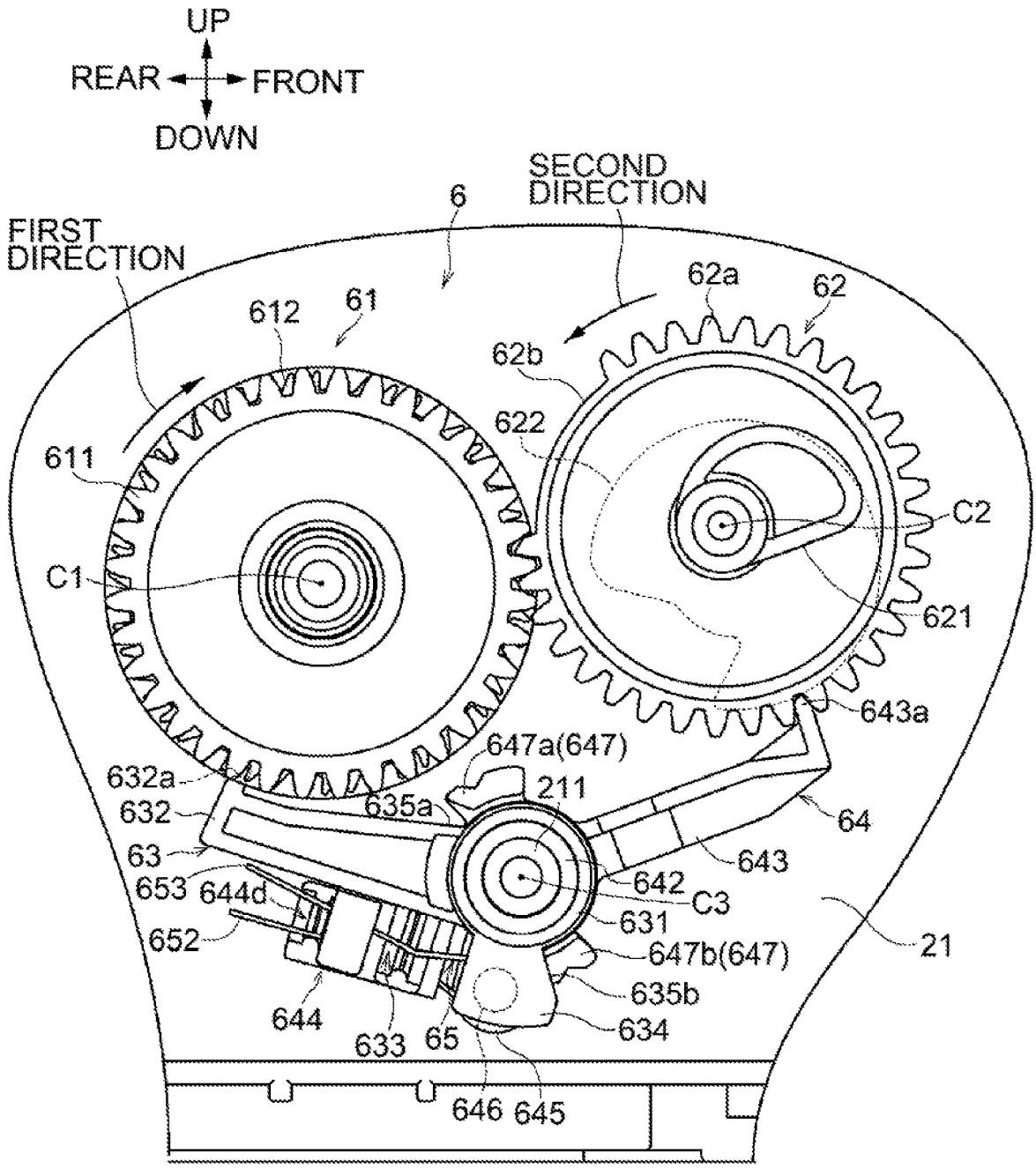
FIG. 10 is a vertical cross sectional view of the drive unit according to aspects of the disclosure, wherein the first pawl of the first arm is in engagement with a second output gear and the first arm is located at the second position.

In response to the second arm 64 pivoting relative to the first arm 63, as illustrated in FIG. 10, the first arm 63 pivots to the second position and the second contactable portion 647*b* and the second position restriction portion 635*b* come into contact with each other. During the state change from the state of FIG. 9 to the state of FIG. 10, the first arm 63 is urged toward the second output gear 613 by the urging force of the torsion spring 65.

As described above, the first arm 63 and the second arm 64 are configured to drive the switch gear assembly 61 of the drive unit 6 to change the destination to which a drive force is transmitted. In addition, the first arm 63 includes the covering portion 634. The first arm 63 may thus also serve as a stopper for the torsion spring 65.

In this example, the second arm 64 is configured to contact the second cam 622 and the first arm 63 is configured to engage the second output gear 613. Nevertheless, in another example, the first arm 63 may be configured to contact the second cam 622 and the second arm 64 may be configured to engage the second output gear 613.

What is claimed is:

1. An image forming apparatus comprising:

a drive unit disposed inside a housing of the image forming apparatus and configured to drive a conveyance unit for conveying a sheet toward an image forming unit;

a support frame supporting the drive unit;

a protrusion having a proximal end and a distal end, the distal end being farther from the support frame than the proximal end being from the support frame; and a support portion supporting the proximal end of the protrusion, wherein the drive unit further includes:

a torsion spring including a spiral portion engaged with the protrusion, a first portion extending from the spiral portion, and a second portion extending from the spiral portion; and an arm pivotable about a pivot axis and including a covering portion, the covering portion extending from the arm and covering the distal end of the protrusion.

2. The image forming apparatus according to claim 1, wherein the arm is pivotable between a first position and a second position, and wherein the arm further includes:

a first position restriction portion configured to cause the arm to stop at the first position such that, when the arm is located at the first position, the covering portion covers the distal end of the protrusion; and a second position restriction portion configured to cause the arm to stop at the second position such that, when the arm is located at the second position, the covering portion covers the distal end of the protrusion.

3. The image forming apparatus according to claim 2, wherein the arm comprises a first arm, the image forming apparatus further comprising a second arm pivotable about the pivot axis of the first arm, wherein the protrusion is located at the second arm.

4. The image forming apparatus according to claim 3, wherein the second arm includes:

a restriction portion configured to restrict movement of the first portion of the torsion spring; and a guide portion configured to guide the first portion of the torsion spring during attachment of the torsion spring to the second arm.

5. The image forming apparatus according to claim 3, wherein the second arm is disposed closer to the proximal end of the protrusion than the first arm is to the proximal end of the protrusion, and wherein the second arm includes a handle, the handle extending to a particular position in a protruding direction of the protrusion such that the handle overlaps the first arm when viewed in a direction perpendicular to the protruding direction.

6. The image forming apparatus according to claim 5, wherein the handle includes:

a first contactable portion configured to, when the first arm is located at the first position, contact the first position restriction portion; and a second contactable portion configured to, when the first arm is located at the second position, contact the second position restriction portion.

7. The image forming apparatus according to claim 3, wherein the drive unit further includes:

a cam configured to pivot one of the first arm and the second arm; and a switch gear assembly including:

an input gear configured to receive a drive force from a drive source;

a first output gear configured to output the drive force; and a second output gear configured to output the drive force, wherein, in response to one of the first arm and the second arm being pivoted by the cam, the other of the first arm and the second arm moves between an engaged position at which the other of first arm and the second arm is in engagement with the switch gear assembly and the first output gear outputs the drive force and a disengaged position at which the other of first arm and the second arm is not in engagement with the switch gear assembly and the second output gear outputs the drive force.

8. An image forming apparatus comprising:

a drive unit disposed inside a housing of the image forming apparatus and including a gear, the drive unit being configured to drive a conveyance unit for conveying a sheet toward an image forming unit;

a support frame supporting the gear; and a protrusion having a proximal end and a distal end, the distal end being farther from the support frame than the proximal end being from the support frame, wherein the drive unit further includes:

a torsion spring including a spiral portion engaged with the protrusion, a first portion extending from the spiral portion, and a second portion extending from the spiral portion; and an arm pivotable about a pivot axis and including a covering portion, the covering portion extending from the arm and covering the distal end of the protrusion.

* * * * *